US010006229B2

(12) United States Patent
Beck

(10) Patent No.: US 10,006,229 B2
(45) Date of Patent: Jun. 26, 2018

(54) DOOR HANDLE ASSEMBLY FOR A VEHICLE

(71) Applicant: Andreas Beck, Bochum (DE)

(72) Inventor: Andreas Beck, Bochum (DE)

(73) Assignee: Huf Huelsbeck & Fuerst GmbH & Co. KG, Velbert (DE)

( * ) Notice: Subject to any disclaimer, the term of this patent is extended or adjusted under 35 U.S.C. 154(b) by 0 days. days.

(21) Appl. No.: 15/291,801

(22) Filed: Oct. 12, 2016

(65) Prior Publication Data

US 2017/0159333 A1 Jun. 8, 2017

(30) Foreign Application Priority Data

Dec. 7, 2015 (DE) ..... 10 2015 121 222
Dec. 21, 2015 (DE) ..... 10 2015 122 365

(51) Int. Cl.
*E05B 81/90* (2014.01)
*E05B 85/06* (2014.01)
(Continued)

(52) U.S. Cl.
CPC ..... *E05B 81/90* (2013.01); *E05B 79/06* (2013.01); *E05B 79/10* (2013.01); *E05B 79/20* (2013.01);
(Continued)

(58) Field of Classification Search
CPC ..... E05B 79/00; E05B 79/02; E05B 79/06; E05B 79/10; E05B 81/90; E05B 85/00; E05B 85/06; E05B 85/14; E05B 85/16
See application file for complete search history.

(56) References Cited

U.S. PATENT DOCUMENTS 2,208,818 A 7/1940 Schaffler
4,706,478 A * 11/1987 Swan ..... E05L 35/00 292/336.3
(Continued)

FOREIGN PATENT DOCUMENTS

DE 197 22 503 A1 12/1997
DE 101 28 866 A1 12/2002
(Continued)

OTHER PUBLICATIONS

European Search Report of European Application No. EP 16 19 3241 dated Apr. 11, 2017, 9 pages.
(Continued)

*Primary Examiner* — Christopher J Boswell
(74) *Attorney, Agent, or Firm* — Fay Sharpe LLP

(57) ABSTRACT

A door handle arrangement for a motor vehicle, includes a support, a handle that is swivel-mounted on the support to be moved between a rest position and an actuated position along a first movement path, a locking cylinder and a resetting device. The handle can be pivoted with respect to the locking cylinder into a release position in such a way that it can be lifted off the locking cylinder and the locking cylinder is released for inserting a key. The handle is designed in such a way that it can be pivoted from the actuated position along a second movement path, which is adjacent to the first movement path, into the release position, wherein in the release position of the handle, the handle is retained in its release position by a locking element.

20 Claims, 2 Drawing Sheets

(51) Int. Cl.

| | |
|---|---|
| ***E05B 79/10*** | (2014.01) |
| ***E05B 85/16*** | (2014.01) |
| ***E05B 79/06*** | (2014.01) |
| ***E05B 79/20*** | (2014.01) |
| ***E05B 81/78*** | (2014.01) |

(52) U.S. Cl.
CPC ..... *E05B 81/78* (2013.01); *E05B 85/06* (2013.01); *E05B 85/16* (2013.01)

(56) References Cited

U.S. PATENT DOCUMENTS

| | | | | |
|---|---|---|---|---|
| 5,497,641 | A | 3/1996 | Linde et al. | |
| 6,240,755 | B1 * | 6/2001 | Da Silva | E05L 317/186 292/336.3 |
| 6,698,262 | B2 * | 3/2004 | Wittwer | E05B 85/107 292/336.3 |
| 7,387,004 | B2 * | 6/2008 | Schutz | E05B 85/107 70/208 |
| 7,748,246 | B1 * | 7/2010 | Paige | E05L 31/0092 292/207 |
| 8,146,393 | B2 * | 4/2012 | Katagiri | E05L 317/18 292/336.3 |
| 9,593,514 | B2 * | 3/2017 | Patel | E05B 83/36 |
| 2009/0205383 | A1 | 8/2009 | Katagiri et al. | |
| 2014/0230329 | A1 * | 8/2014 | Patel | E05B 83/36 49/25 |
| 2017/0002589 | A1 * | 1/2017 | Toyama | E05B 85/06 |

FOREIGN PATENT DOCUMENTS

| | | | |
|---|---|---|---|
| DE | 10 2006 027473 | A1 | 12/2007 |
| DE | 10 2006 029774 | A1 | 1/2008 |
| DE | 10 2007 052248 | A1 | 6/2008 |
| DE | 10 2008 000190 | A1 | 8/2009 |
| EP | 0 584 499 | A1 | 3/1994 |

OTHER PUBLICATIONS

European Search Report of European Application No. EP 16 19 3103 dated Apr. 20, 2017, 6 pages.

* cited by examiner

DOOR HANDLE ASSEMBLY FOR A VEHICLE

BACKGROUND

The invention relates to a door handle arrangement for a motor vehicle, which has a support that can be mounted on the inside of a door of the motor vehicle, a handle that can be arranged on the outside of the vehicle door and that is swivel-mounted on the support to be moved between a rest position and an actuated position along a first movement path and to be grasped by a user, a locking cylinder and a cover for the locking cylinder and a resetting device that pushes the handle with a reset force into rest position, wherein the handle is designed in such a way that it forms in rest position the cover for the locking cylinder, wherein a first longitudinal end of the handle is swivel-mounted on the support and a second longitudinal end of the handle is coupled with the support and can be moved away from the support, wherein the handle can be pivoted with respect to the locking cylinder into a release position in such a way that it can be lifted off the locking cylinder and the locking cylinder is released for inserting a key, and wherein the handle has a cavity which receives the locking cylinder at least partially when the handle is in rest position. In particular, the invention relates to a door handle arrangement in which a mechanically actuated locking cylinder is arranged in concealed manner.

The door handle arrangement for a vehicle comprises a handle which can be pivoted toward the vehicle between a rest position and an actuated position. A user can grasp the handle to open an attached vehicle door. In addition, the door handle arrangement has a locking cylinder which can be closed with a cover. Door handle arrangements of this type are used when the vehicle is provided with an electronic access function (keyless entry). As a result, it is not required to utilize a mechanical locking function during normal use of the vehicle. However, because of temporary or permanent interruptions or, for example, an empty battery of equipment required for the electronic access function, a mechanical emergency or auxiliary locking device is formed on at least one door handle arrangement of the vehicle. Such a mechanical locking device is provided with a locking cylinder into which an associated key can be inserted to perform a locking function.

For example, a door arrangement of the type mentioned above has been disclosed in DE 10 2008 000 190 A1, in which the handle comprises a cavity which receives the locking cylinder at least partially when the handle is in rest position. However, when the handle is in release position, a key can be inserted past the handle into the locking cylinder. However, this well-known door handle arrangement has the disadvantage that the user has to hold the handle with one hand in the release position, while using the other hand to insert the key into the locking cylinder in order to perform the locking function. At the same time, the user has to hold the handle in the release position against a reset force, which can require a great deal of effort. Consequently, in the well-known door handle arrangement, the emergency action of opening the vehicle door is not very user-friendly.

Therefore, the invention is based on the objective of providing a constructively simple door handle arrangement that can be produced cost-effectively and that is easy to handle if it is required to perform the locking function by means of a key.

BRIEF SUMMARY

According to the invention, for a door handle arrangement of a motor vehicle of the type mentioned above, this objective is achieved in that the handle is designed in such a way that it can be pivoted from the actuated position along a second movement path, which is adjacent to the first movement path, into the release position, wherein in the release position of the handle the handle is retained in its release position by means of a locking means.

Advantageous and practical embodiments and further developments of the invention are included in the subclaims.

The invention-based door handle arrangement of the type mentioned above has a handle which is designed in such way that it forms in its rest position the cover for the locking cylinder. At the same time, the rest position is the position which the handle assumes without being actuated by a user. According to the invention, the handle is designed in one piece with the cover. The handle can be pivoted into a release position in relation to the locking cylinder in such a way that it is lifted during the pivoting movement off the locking cylinder and the locking cylinder is released for a key to be inserted into an insertion opening of the locking cylinder. In addition, the locking means ensure that the handle is retained in the release position when it has reached the release position at the end of the second movement path. In the release position, it is especially convenient and easy to insert a key into the locking cylinder because the user no longer has to hold the key in the release position because, according to the invention, this function is assumed by the locking means. If, therefore, a mechanical locking function by means of a key should be performed by the user, the user swings the handle from the rest position into the release position, in which the handle is retained by the locking means. Now the user can insert a mechanical key into the released locking cylinder and perform the locking motion.

The handle has a cavity which receives the locking cylinder at least partially when the handle is in rest position. Part of the locking cylinder is received in the cavity and correspondingly surrounded by the one-piece handle cover. As a result, not only the view on the locking cylinder is obscured but it is also protected against laterally impacting influences, as well as against environmental influences.

Such a door handle arrangement can be designed on one or multiple vehicle door handles.

In a preferred embodiment of the invention, the locking means also represents the reset means. Because of this dual function, it is possible to eliminate one component. This, in turn, reduces production costs and installation time. Structurally, it is of special benefit when the locking means comprises a flexible spring element. The locking means ensures that the handle is retained in the release position when the handle has reached the end of the second movement path.

Furthermore, in accordance with the preferred embodiment, it is of advantage when the flexible spring element is arranged at the support and comprises at least one leg spring with two spring legs, wherein the first spring leg is retained at the support and the second spring leg is connected with the second longitudinal end of the handle in such a way that a movement of the handle at least in the direction of its actuated position compresses the flexible spring element. As a result, in this embodiment, the locking means acts also as reset means as long as the handle is pivoted along the first actuating travel up to its actuated position.

In order for the handle to be retained in its release position, a further embodiment of the invention provides that the locking means comprises a locking recess into which the second spring leg of the flexible spring element engages when the handle is moved in release position at the end of the second movement path in such a way that the handle is retained in release position and a key can be inserted into the locking cylinder.

For an alternative embodiment, the invention provides that the locking means comprises a flexible spring element, which is mounted on an axis at the support or on the first longitudinal end of the handle. In any case, the flexible spring element is fixed at the support opposite of the swivel-mounted handle, which facilitates the assembly compared to attaching the locking means at a movable component.

The alternative embodiment differs from the preferred embodiment in that the locking means is attached at the first longitudinal end of the handle and is there engaged at the handle in order to retain it in the release position. Accordingly, it is specifically provided that the flexible spring element comprises at least one leg spring with two spring legs, wherein the first spring leg is retained at the support and the second spring leg is connected with the first longitudinal end of the handle in such a way that at the end of the second movement path the handle is retained in its release position.

For normally opening the vehicle door (in so-called keyless entry operation), the user touches the handle and performs a pivoting movement with the handle. In the process, the handle is pivoted from the rest position into an actuated position, wherein a locking device of the door is actuated on the inside of the door if the electronic release of the door has been carried out. However, if a mechanical (emergency) locking function should be carried out, the user can perform the respective movement with slightly increased force. As a result, the handle is brought into the release position and is retained there and the locking cylinder is exposed to a locking function. This is advantageous, because in a situation in which the usual locking function fails, the user is already under high pressure. If the user merely has to perform the usual actuation of the door handle with a higher force in order to attain the mechanical door handle, this is the simplest and most obvious operating option for the user. Accordingly, the invention provides that the handle can be transferred with normal actuating force from rest position to actuated position, wherein the force required for moving the handle into the release position is greater than the normal actuating force. Therefore, it is only required that the user applies a higher force in order to transfer the handle into the release position, where it is then retained by the locking means.

It naturally follows that the above-mentioned characteristics, as well as those subsequently described, can be used not only in the combination specified, but also in different combinations or on their own, without leaving the scope of the present invention. The scope of the invention is only defined by the claims.

BRIEF DESCRIPTION OF THE DRAWINGS

Additional details, characteristics and advantages of the subject matter of the invention are included in the subsequent description in connection with the drawing, in which preferred embodiments of the invention are explained in an exemplary manner. In the drawings.

DETAILED DESCRIPTION

Figure 1:
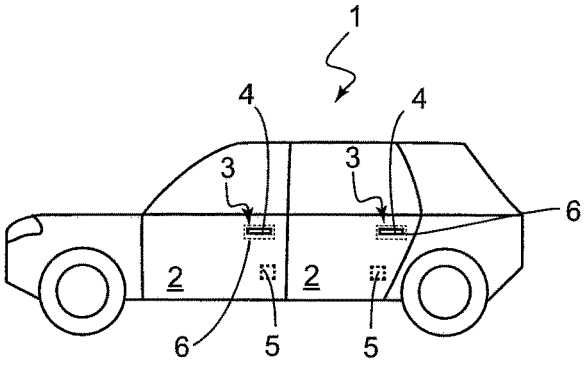
FIG. 1 shows a schematic side view of a vehicle which can be opened by a door handle arrangement according to the invention.

FIG. 1 shows in an exemplary manner a vehicle or motor vehicle 1 in the form of a passenger car, which has four doors 2 (two of which are shown in FIG. 1), which can be opened by means of a door handle arrangement 3 and especially by means of a door handle or operating handle 4. The doors 2 are tightly closed by means of respective locking arrangements 5 and can be opened from the outside by respectively moving the handle 4. This movement of the handle 4 can comprise a pull and/or flap motion, wherein the associate door 2 can be opened with a respective movement of the handle 4. In addition to the handle 4, the invention-based door handle arrangement 3 comprises a support 6, which is shown in FIG. 1 with a dotted line, and which is mounted on the exterior of the body of the door 2. The handle 4 is arranged on the exterior of the door 2 of the motor vehicle 1 and mounted on the support 6 by means of through holes in the body of the door 2.

Figure 2:
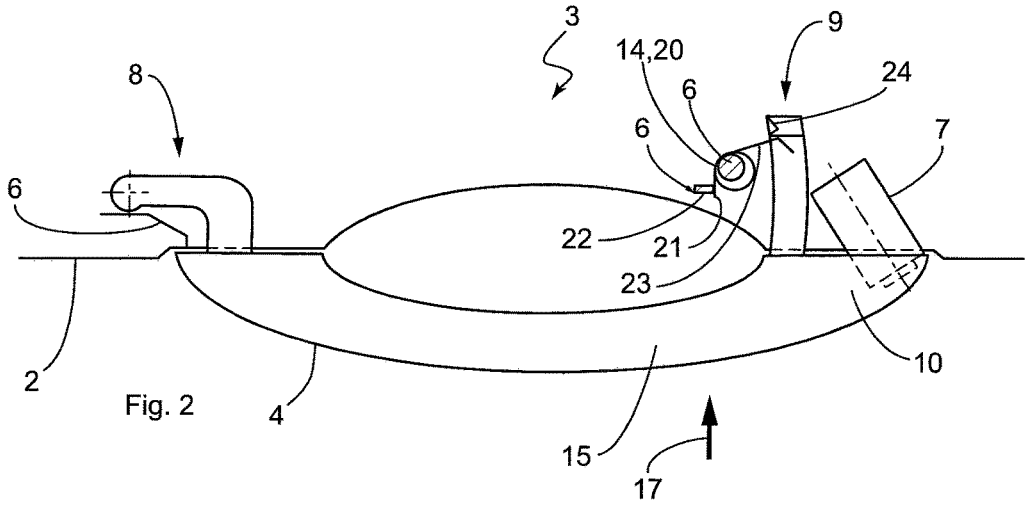
FIG. 2 shows a schematic sectional view of a first embodiment of the invention-based door handle arrangement with a handle in rest position.
Figure 3:
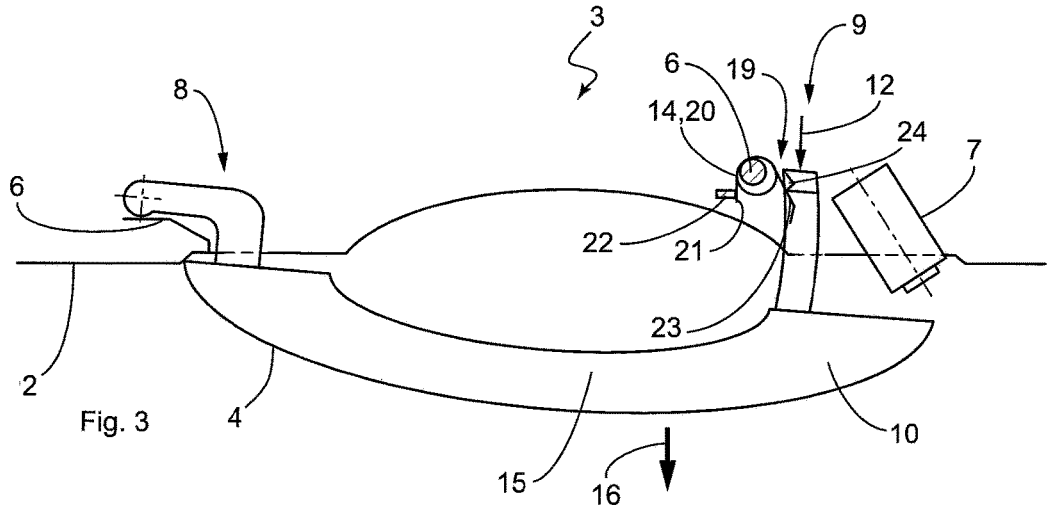
FIG. 3 shows a schematic sectional view of the first embodiment of the invention-based door handle arrangement with a handle in actuated position.
Figure 4:
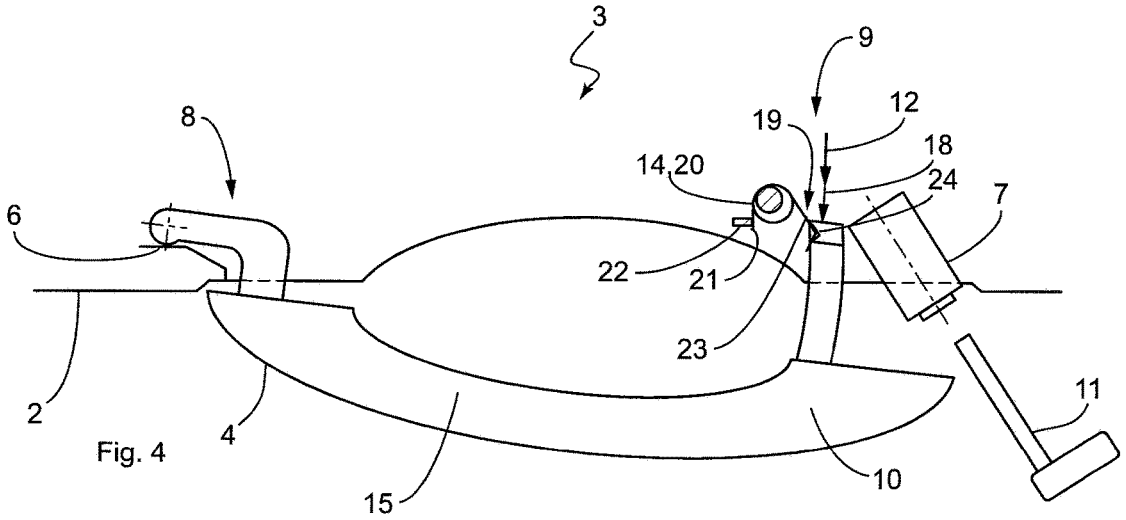
FIG. 4 shows a schematic sectional view of the first embodiment of the invention-based door handle arrangement with a handle in release position.

FIGS. 2 to 4 show a first embodiment of the invention-based door handle arrangement 3, which comprises a handle 4, the support, which is indicated only schematically, as well as a locking cylinder 7. The locking cylinder 7 is also fixed at the support and is covered by the handle 4 in its rest position, as shown in FIG. 2. An overview of FIGS. 2 to 4 shows that a first longitudinal end 8 of the handle 4 is mounted on the support 6 in such a way that it can be swiveled over a bearing section. A second longitudinal end 9 of the handle 4 is coupled at the support in such a way that it can be moved away from the door 4. In the present example, the handle 4 is shown to be hollow. However, it can contain any electronic communication devices or other mechanical components and elements. Since they are not relevant for the present invention, they are not shown.

In the longitudinal extension at the second longitudinal end 9 of the handle 4, there is a cavity or receiving space which partially receives the locking cylinder 7 in the rest position of the handle 4 shown in FIG. 2. In the rest position of the handle 4 shown in FIG. 2, the locking cylinder is encapsulated toward the surrounding area and completely concealed. In this way, the handle 4 forms a cover 15 for the locking cylinder 7. In this position, it is not possible to insert an associated emergency key 11 into the locking cylinder 7, in order to perform the locking motion, because the insertion opening in the locking cylinder is not released in the rest position (see FIG. 2) of the handle 4. During normal use of the door handle of the motor vehicle, the user does not notice that below the handle or covered by it there is the locking cylinder, which can be used in a case of emergency for unlocking the door 2. For normal actuation of the handle 4, the user reaches behind the handle and pulls the handle with normal actuating force 16 and swings the handle into its actuated position (see FIG. 3), in order to release the door 2.

Provided the electronic communication between the ID transmitter on the side of the user and the control device on the side of the vehicle functions properly, the door 2 is opened by pulling the handle 4 with normal actuating force 16 and performing the pivoting movement about the first longitudinal end 8, as shown in FIG. 3. In FIG. 3, the handle 4 is arranged in an actuated position and covered a first movement path 12 as a result of the pivoting movement. To open the door 2, the handle 4 is provided with appropriate mechanical coupling means (not shown), which allow the door 4 to be unlocked on the inside of the door. However, if for any reason the electronic communication fails, the user can reach behind the handle 4 and perform the respective pivoting movement of the handle 4. Because of the lack of wireless communication, this action does not unlock the door, but it releases partially the cavity 10 below the handle 4. Due to the inclined position of the locking cylinder 7 in relation to the 4 door, it is only required to slightly lift the door handle from the emergency locking cylinder 7. Only a small pivoting angle of the handle 4 is sufficient to allow for the emergency key 11 to be inserted. The emergency key 11 an be inserted into the locking cylinder 7 and turned in order to mechanically unlock the door lock. In other words, the handle 4 can be pivoted into a position in relation to the locking cylinder 7 that it can be lifted off the locking cylinder 7 and the locking cylinder is released for inserting the (emergency) key 11. After the mechanical locking motion has been performed, the key 11 can be removed and the handle 4 is swiveled back and receives the emergency locking cylinder 7 in its cavity 10.

To make this actuation user-friendly and easy to operate, the invention provides that, in a case of emergency in which the mechanical key 11 has to be used to unlock the door lock, the handle 4 is retained in a position in which it is lifted or swiveled away from the vehicle wall, so that the user can perform the emergency action of opening the vehicle door 2 with only one hand. The handle 4 is supplied with a resetting device 14, which pushes the handle 4 with a reset force 17 back into its rest position, when the handle is swiveled out.

In order for the handle 4 to remain in swiveled-out condition in a case of emergency and not be pushed back into its rest position, the invention provides that the handle 4 is designed in such a way that it can be pivoted from the actuated position along a second movement path 18, which is adjacent to the first movement path 12, into the release position. As a result, the handle 4 has to be pivoted into the release position beyond its actuated position, so that the handle 4 is automatically retained by a mechanism in its release position and not pivoted back into its rest position. In the release position of the handle 4, the handle 4 is retained in its release position by means of a locking means 19, as shown in FIG. 4. The locking means 19 prevents the handle 4 from being pushed back into the rest position. The handle 4 can be transferred from the rest position into the actuated position by means of a normal actuating force 16. However, the force required for moving the handle 4 into the release position is greater than the normal actuating force 16.

In the first embodiment according to FIGS. 2 to 4, the locking means 19 also represents the resetting device 14. At the same time, the locking means 19 comprises a flexible spring element 20 in the form of a leg spring and retains the handle 4 in the release position (see FIG. 4). The flexible spring element 20 is arranged at the support 6 and there mounted about an axis formed at the support. At the same time, a first spring leg 21 of the flexible spring element 20 is supported on a supporting projection 22 at the support 6. A second spring leg 23 is connected with the second longitudinal end 9 of the handle 4 in such a way that a movement of the handle 4 at least in the direction of its actuated position impacts and thus compresses the flexible spring element 20. In order for the handle 4 to be retained in the release position, the locking means comprises in addition to the flexible spring element 20 an engagement recess 24, which is formed at the second longitudinal end 9 of the handle 4. The engagement recess 24 has the purpose that when the handle 4 is moved into the release position, the second spring leg 23 of the flexible spring element 20 engages at the end of the second movement path 18 into the engagement recess 24 in such a way that the handle 4 is retained in the release position and the key can be easily inserted into the locking cylinder 7, and the user does not have to hold the handle 4 in a swiveled-out position.

Figure 5:
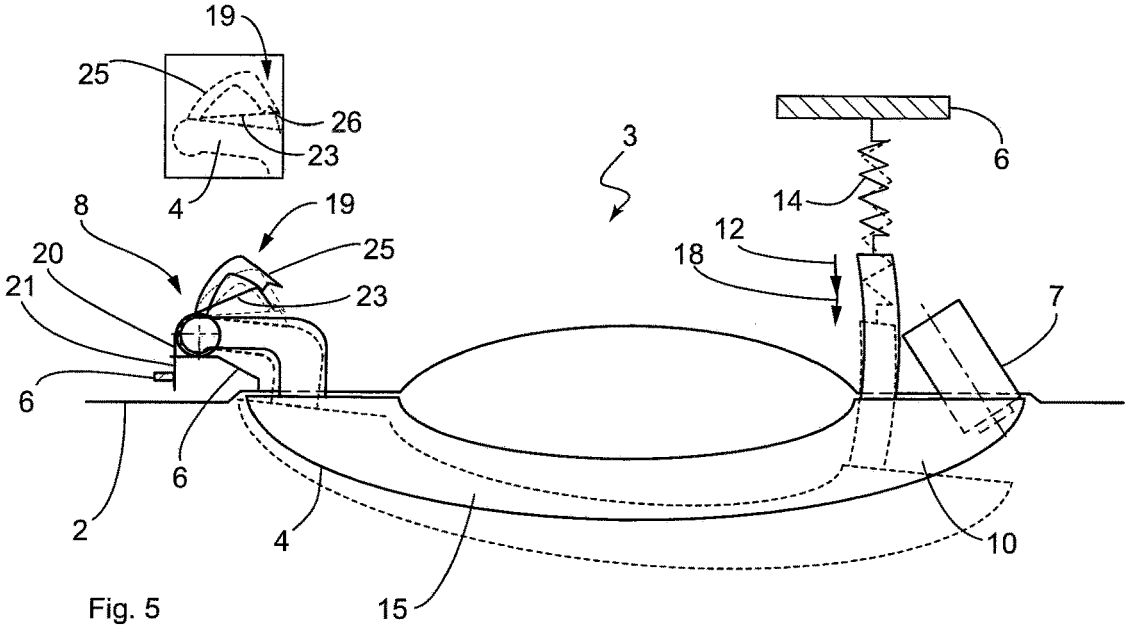
FIG. 5 shows a schematic sectional view of a second embodiment of the invention-based door handle arrangement.
Figure 6:
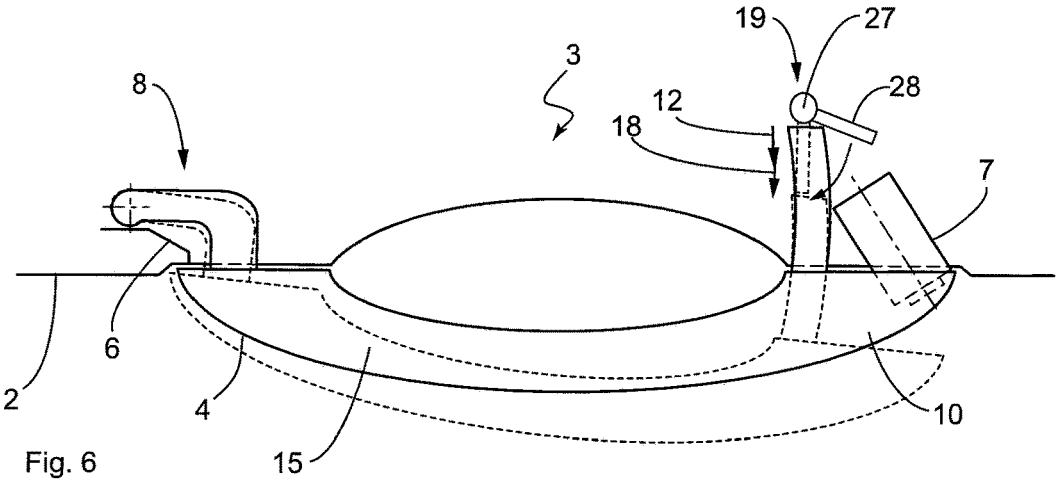
FIG. 6 shows a schematic sectional view of a third embodiment of the invention-based door handle arrangement.

Reference numerals used in the two embodiments shown in FIGS. 5 and 6 that correspond to the first embodiment according to FIGS. 2 to 4, refer to identical or similar elements or components. Therefore, reference can be made to the preceding description, which is also valid for the embodiments shown in FIGS. 5 and 6.

FIG. 5 shows a second embodiment of the invention. The door handle arrangement 3 shown there comprises the handle 4, the locking cylinder 7 and the support 6, which is indicated only schematically. The handle 4 is pushed by the resetting device 14 into its rest position, wherein the resetting device 14 is designed in the form of a spring, which in the embodiment shown is fixed with one end at the support 6, while the other end is attached at the grip hook of the handle 4. FIG. 5 shows the rest position of the handle 4 by means of a continuous line and the release position by means of a dotted line. For reasons of clarity, the actuated position, which occurs between the rest position and the release position, is not shown.

Consequently, an actuation of the handle 4 takes place against the spring force of the resetting device 14, wherein it is obvious that a deflection of the handle 4 beyond the first movement path 12 requires a greater force than for a normal actuation of the handle 4. In a case of emergency, a force greater than the normal actuating force 16 has to be applied to move the handle 4 along the second actuating travel 18 into its release position, so that the handle 4 can be retained by the locking means 19 in the release position. Like in the first embodiment, the locking means 19 comprises a flexible spring element 20. However, in the second embodiment, the flexible spring element 20 is wound at the first longitudinal end 8 of the handle 4 about its spindle. The spindle is fixed in swivel-mounted manner at the support 6 and rotates when the handle 4 is actuated in order to allow the handle to be swiveled out. Alternatively, the flexible spring element 20 could also be wound at the support 6 about a respective axis. Also in the second embodiment, the flexible spring element 20 is designed in the form of a leg spring. The first spring leg 21 is supported by the supporting projection 22, which this time is formed on the first longitudinal end 8 of the handle 4 at the support 6. The second spring leg 23, on the other hand, is located at an arm-shaped projection 25 of the handle 4. An engagement recess 26 is formed at the free end of the projection 25. In a case of emergency, the user can swing the handle 4 along the first and second movement path 12 or 18, wherein at least during the movement along the second movement path 18 the second spring leg 23 is compressed in the direction of the handle 4 by the arm-shaped projection 25, until it reaches and snaps into the engagement recess 26, thus reducing the compression of the spring element 20. This arrangement of the second spring leg 23 is depicted in sectional view A and shows how the second spring leg 23 is received in the engagement recess 26. It ensures that the handle 4 is retained in the release position, so as to be able to conveniently insert a key into the locking cylinder 7 in order to open the door in a case of emergency without having to hold the handle 4 with the other hand in the release position. Consequently, the second spring leg 23 is connected with the first longitudinal end 8 of the handle 4 in such a way that at the end of the second movement path 18 the handle 4 is retained in its release position.

FIG. 6 shows a third embodiment of the present invention, wherein the structure of the door handle arrangement 3, as well as its function, is mostly identical with the other two embodiments, so that it is not necessary to provide another detailed description. Subsequently, we will address merely the differences to the other two embodiments. The door handle arrangement 3 again comprises the handle 4, the locking cylinder 7, the support 6 on which the handle 4 is mounted in the way described above and to which the locking cylinder is attached, a resetting device (not shown in FIG. 6) which pushes the handle 4 into its rest position, and the locking means 19. The locking means 19 is arranged at the second longitudinal end 9 of the handle 4 and mounted to the support 6 or a different fixed part of the door 4 (in relation to the swivel-mounted handle 4). The locking means 19 can be rotated about a rotational axis 27, wherein a spring preload ensures that the locking means 19 is rotated in clockwise direction or in the direction of the handle 4. In rest position of the handle 4, a blocking arm 28 of the locking means 19 is arranged lateral of the grip hook of the handle 4, wherein the spring preload presses the blocking arm 28 against the grip hook. If the handle is swiveled out, the blocking arm 8 remains for the first movement path 12 of the handle 4 laterally attached to the grip hook. Only when the handle 4 is moved along the second movement path 18 and reaches the release position, the blocking arm 8 can swivel out of the lateral arrangement. The blocking arm 8 is then in alignment with the grip hook, which makes it impossible to move the handle 4 back into the rest position or actuated position, because the blocking arm 28 prevents a return movement of the handle 4. In this way, it is possible in a case of emergency to swing the handle 4 out and retain it in the release position, in order to ensure convenient access to the locking cylinder 7, just as it was described above for the two other embodiments.

Naturally, the invention described above is not limited to the embodiment described and shown. It is obvious that it is possible to make numerous changes on the embodiments shown in the drawing, which would be manifest to an expert in accordance with any intended application, without leaving the scope of the invention. The invention involves everything included in the description and/or the drawing, including anything that would be obvious to an expert but deviate from the concrete embodiments.

The invention claimed is:

1. A door handle arrangement for a motor vehicle, comprising a support that can be mounted on the inside of a door of the motor vehicle, a handle adapted to be grasped by a user and arranged on the outside of the door of the motor vehicle and that is swivel-mounted on the support so that it is moved between a rest position and an actuated position along a first movement path, a locking cylinder and a cover for the locking cylinder, and a resetting device that pushes the handle with a reset force into rest position, wherein the handle is designed in such a way that it forms in rest position the cover for the locking cylinder, wherein a first longitudinal end of the handle is swivel-mounted on the support and a second longitudinal end of the handle is coupled with the support and is adapted to be moved away from the support, wherein the handle is adapted to be pivoted with respect to the locking cylinder into a release position in such a way that it can be lifted off the locking cylinder and the locking cylinder is released for inserting a key, and wherein the handle includes a cavity which receives the locking cylinder at least partially when the handle is in rest position, wherein the handle is designed in such a way that it can be pivoted from the actuated position along a second movement path, which is adjacent to the first movement path, into the release position, wherein in the release position of the handle, the handle is retained in its release position by a locking means.

2. A door handle arrangement according to claim 1, wherein the locking means also comprises the resetting device.

3. A door handle arrangement according to claim 2, wherein the locking means comprises a flexible spring element, which ensures that the handle is retained in the release position.

4. A door handle arrangement according to claim 3, wherein the flexible spring element is arranged at the support and comprises at least one spring with two spring legs, wherein a first spring leg is retained at the support and a second spring leg is connected with the second longitudinal end of the handle in such a way that a movement of the handle at least in the direction of its actuated position compresses the flexible spring element.

5. A door handle arrangement according to claim 4, wherein the locking means comprises a locking recess, which is formed at the second longitudinal end of the handle, into which locking recess the second spring leg of the flexible spring element engages when the handle is moved into the release position at the end of the second movement path in such a way that the handle is retained in the release position and a key can be inserted into the locking cylinder.

6. A door handle arrangement according to claim 1, wherein the locking means comprises a flexible spring element, which ensures that the handle is retained in the release position.

7. A door handle arrangement according to claim 6, wherein the flexible spring element is arranged at the support and comprises at least one spring with two spring legs, wherein a first spring leg is retained at the support and a second spring leg is connected with the second longitudinal end of the handle in such a way that a movement of the handle at least in the direction of its actuated position compresses the flexible spring element.

8. A door handle arrangement according to claim 7, wherein the locking means comprises a locking recess, which is formed at the second longitudinal end of the handle, into which locking recess the second spring leg of the flexible spring element engages when the handle is moved into the release position at the end of the second movement path in such a way that the handle is retained in the release position and a key can be inserted into the locking cylinder.

9. A door handle arrangement according to claim 1, wherein the locking means comprises a flexible spring element, which is mounted on an axis at the support or on the first longitudinal end of the handle.

10. A door handle arrangement according to claim 9, wherein the flexible spring element comprises at least one spring with two spring legs, wherein a first spring leg is retained at the support and a second spring leg is connected with the first longitudinal end of the handle in such a way that at the end of the second movement path the handle is retained in its release position.

11. A door handle arrangement according to claim 1, wherein the handle is adapted to be transferred with a normal actuating force from the rest position to the actuated position, wherein a force required for moving the handle into the release position is greater than the normal actuating force.

12. A door handle arrangement for a motor vehicle, comprising:

a support mounted on an inside of a door of the motor vehicle;

a handle adapted to be grasped by a user and arranged on an outside of the door of the motor vehicle and movable between a rest position and an actuated position along a first movement path, wherein a first longitudinal end of the handle is swivel-mounted on the support and a second longitudinal end of the handle is coupled with the support and is adapted to be moved away from the support;

a locking cylinder mounted to the door of the motor vehicle, wherein the handle includes a cavity which at least partially receives the locking cylinder when the handle is in the rest position;

a resetting device urges the handle with a reset force into the rest position, wherein the handle is designed in such a way that in the rest position the handle forms a cover for the locking cylinder;

wherein the handle is adapted to be pivoted with respect to the locking cylinder into a release position in such a way that the handle can be lifted off the locking cylinder exposing the locking cylinder for inserting a key, a locking member mounted to the door of the motor vehicle, and wherein the handle is pivotable from the actuated position along a second movement path, which is adjacent to the first movement path, into the release position, wherein the handle is retained in the release position by the locking member.

13. A door handle arrangement according to claim 12, wherein the locking member comprises a flexible spring element, which ensures that the handle is retained in the release position.

14. A door handle arrangement according to claim 13, wherein the flexible spring element comprises two spring legs, wherein a first spring leg is retained at the support and a second spring leg is connected with the second longitudinal end of the handle in such a way that a movement of the handle at least in the direction of its actuated position compresses the flexible spring element.

15. A door handle arrangement according to claim 13, wherein the flexible spring element is mounted on the first longitudinal end of the handle.

16. A door handle arrangement according to claim 15, wherein the flexible spring element comprises two spring legs, wherein a first spring leg is retained at the support and the second spring leg is connected with the first longitudinal end of the handle in such a way that at the end of the second movement path the handle is retained in its release position.

17. A door handle arrangement according to claim 12, wherein the locking member also comprises the resetting device.

18. A door handle arrangement according to claim 12 wherein the locking member comprises a spring-biased blocking arm.

19. A door handle arrangement according to claim 18 wherein the locking member is located adjacent the locking cylinder.

20. A door handle arrangement according to claim 18 wherein the blocking arm selectively engages the handle.

* * * * *